United States Patent [19]

Platt

[11] Patent Number: 4,499,628

[45] Date of Patent: Feb. 19, 1985

[54] VACUUM CLEANING APPARATUS

[75] Inventor: Clark I. Platt, St. Joseph Township, Berrien County, Mich.

[73] Assignee: Whirlpool Corporation, Benton Harbor, Mich.

[21] Appl. No.: 502,700

[22] Filed: Jun. 9, 1983

[51] Int. Cl.[3] ..... A47L 9/02

[52] U.S. Cl. ..... 15/419; 15/416; 15/420; 15/421

[58] Field of Search ..... 134/21; 15/416, 419, 15/420, 421

[56] References Cited

U.S. PATENT DOCUMENTS

| | | | |
|---|---|---|---|
| 1,348,587 | 8/1920 | Rosenfield | 15/419 X |
| 1,860,854 | 5/1932 | Engberg et al. . | |
| 2,324,111 | 7/1943 | Ross | 15/158 |
| 2,528,278 | 10/1950 | Kendrick | 15/420 |
| 2,659,925 | 11/1953 | Wood | 15/418 |
| 3,005,224 | 10/1961 | Magarian | 15/372 |
| 3,089,178 | 5/1963 | Sherman, Jr. | 15/347 |
| 3,550,183 | 12/1970 | Wolf | 15/420 X |
| 3,862,469 | 1/1975 | Burgoon | 15/357 |
| 3,942,219 | 3/1976 | Johnson | 15/416 X |
| 4,254,525 | 3/1981 | Combest | 15/1.7 |
| 4,416,034 | 11/1983 | Ahlf et al. | 15/419 X |

*Primary Examiner*—Marc L. Caroff

*Attorney, Agent, or Firm*—Wood, Dalton, Phillips, Mason & Rowe

[57] ABSTRACT

A vacuum cleaner structure arranged to provide front edge cleaning fully to the intersection of a floor surface and an upright wall surface by a forward movement of the vacuum cleaner nozzle thereto. The vacuum cleaner structure includes a front wall of the nozzle having openings and associated structure for selectively closing the openings when the nozzle is spaced remotely from the upright wall surface and automatically causing the openings to be opened when the nozzle front wall is closely juxtaposed to the upright wall surface. The closure member, in the illustrated embodiment is pivotally mounted to the front wall and movement thereof is effected by an actuator sensor button slidably mounted in the front wall to overcome the gravity biasing and suction biasing of the closure member to the closed position, as an incident of the front wall of the nozzle being juxtaposed to the upright wall surface.

8 Claims, 4 Drawing Figures

FIG. 1
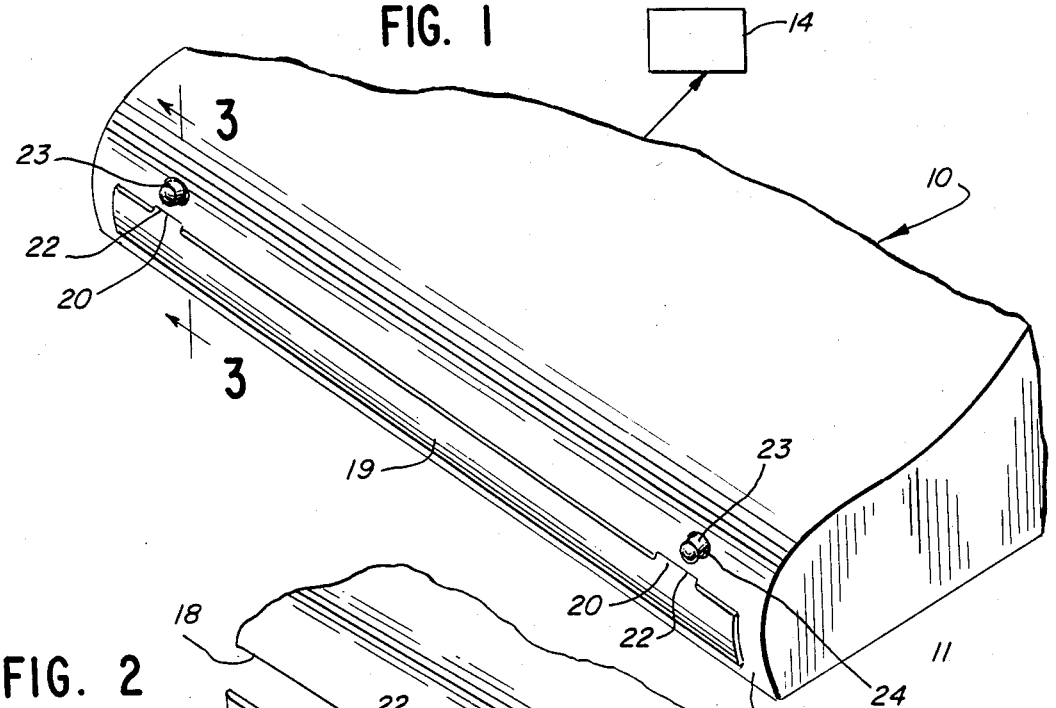
FIG. 2
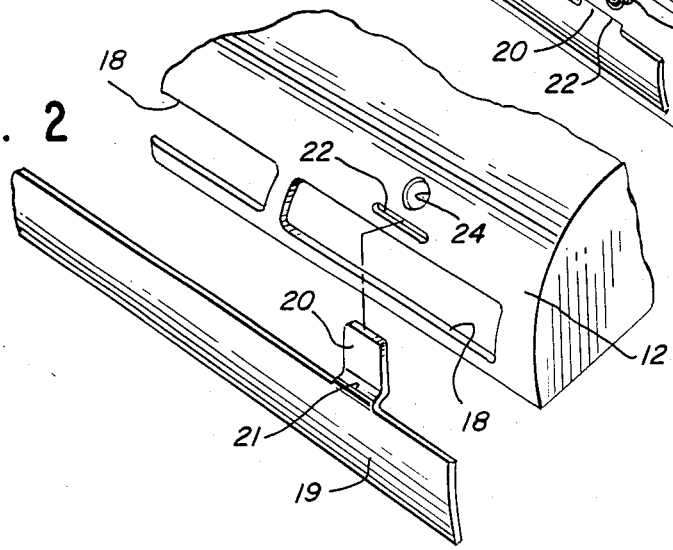
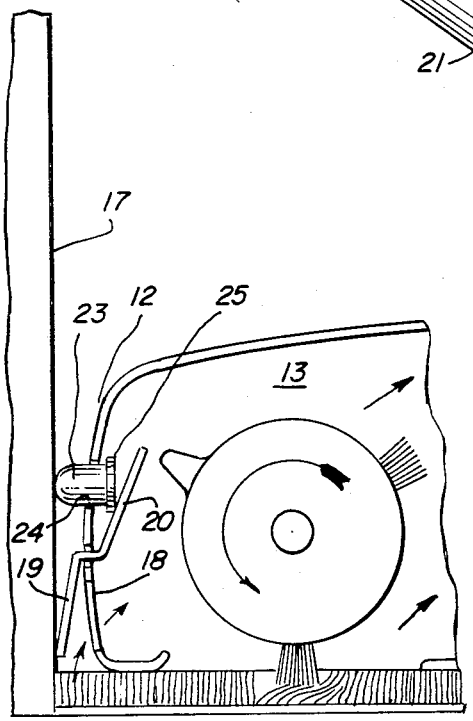
FIG. 4
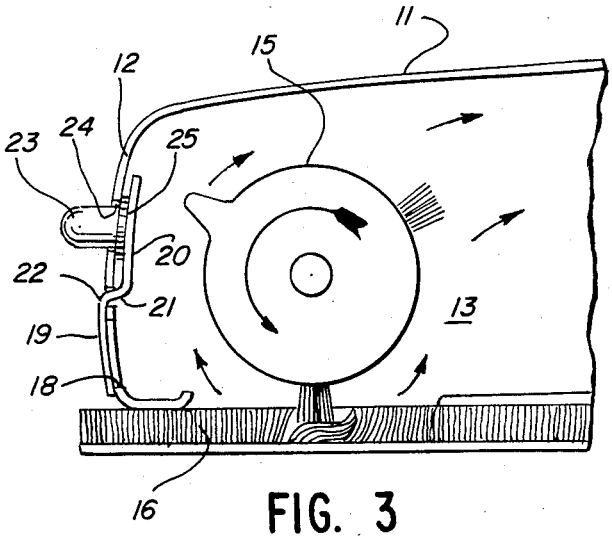
FIG. 3

VACUUM CLEANING APPARATUS

BACKGROUND OF THE INVENTION

1. Field of the Invention

This invention relates to vacuum cleaning, and in particular to vacuum cleaning surfaces closely adjacent to upright wall surfaces.

2. Description of the Background Art

In U.S. Letters Patent No. 2,324,111 of Alvin E. Ross, a suction nozzle is illustrated having an automatically retractable surface contacting brush element. A forwardly projecting spring is connected to the support for the leading brush element of the nozzle so that flattening of the spring when engaging the wall baseboard causes the mounting strip for the leading brush to move in an upward direction, causing the flow of air into the nozzle to be concentrated underneath the forward wall of the nozzle.

Gerald M. Magarian, in U.S. Letters Pat. No. 3,005,224, shows a vacuum cleaner having a pressure relief valve comprising a flap valve hung on a spring wire and pressed against the inner wall of the brush chamber for normally closing a plurality of relief openings in the front wall of the nozzle. In the event the subjacent carpeting is drawn into the normal nozzle suction opening so as to block off the air flow therethrough, the relief valve is opened by the suction pressure increase in the suction chamber, thereby limiting the vacuum in the chamber to a preselected value.

A problem arises in the cleaning of floor or carpet surfaces adjacent upright wall surfaces including vertical wall surfaces of cabinets, furniture, etc. in that it is difficult to maneuver the conventional vacuum cleaner nozzle fully to the upright wall, thus undesirably leaving dirt at the intersection between the floor and wall. This problem is aggravated by the provision of projecting bumpers and the like on the nozzle so that the downwardly opening suction chamber is spaced substantially from the upright wall, such as the baseboard thereof, in its closest disposition. One attempted solution to the problem has been to provide openings on the edge of the nozzle, permitting the user to clean adjacent the baseboard by moving the nozzle along the wall rather than toward and from the wall. Such movement, however, is not always available in close quarters, and the problem of removing the dirt from adjacent the upright wall remains a vexatious problem.

SUMMARY OF THE INVENTION

The present invention comprehends an improved vacuum cleaner construction and method of vacuum cleaning effectively solving this longstanding vexatious problem in a novel and simple manner.

More specifically, the invention comprehends a method of vacuum cleaning a surface to be cleaned adjacent an upright surface, including the steps of providing a vacuum cleaner having a nozzle defining a front wall, means defining a downwardly opening suction chamber rearwardly of the front wall, and means for applying suction to the chamber for picking up dirt from subjacent the chamber, selectively providing an opening to the chamber through the front wall as an incident of the front wall being closely juxtaposed to an upright surface forwardly thereof, and causing dirt on the surface to be cleaned from forwardly subjacent the opening and adjacent the upright surface as a result of the suction in the chamber acting through the opening thereon.

The improved vacuum cleaner structure of the invention includes means for providing an opening to the chamber through the front wall as an incident of the front wall being closely juxtaposed to an upright surface forwardly thereof, the opening being disposed to pick up dirt from forwardly subjacent the opening as a result of the suction in the chamber acting through the opening thereon.

The invention further comprehends the provision in such a vacuum cleaner structure having means for providing an opening to the chamber through the front wall, means for sensing the juxtaposition of the front wall to the upright surface, closure means for selectively closing the opening, and means responsive to the sensing means for causing the closure means to discontinue closing the opening and thereby permit pickup of dirt from forwardly subjacent the opening as a result of the suction in the chamber acting through the opening thereon as an incident of the front wall being closely juxtaposed to an upright surface forwardly thereof.

In the illustrated embodiment, the closure means comprises a closure member movably mounted to the front wall for selectively closing a through opening in the front wall.

In the illustrated embodiment, the closure member is biased to the closed position and is further urged to the closed position by suction existing in the suction chamber.

In the illustrated embodiment, the means for moving the closure member from the closed position comprises a sensing actuator projecting forwardly from the front wall of the nozzle for engagement with the upright wall surface and operatively associated with the closure member to overcome the biasing thereof in effecting the movement of the closure member to the open position.

In the illustrated embodiment, the front wall opening is disposed adjacent the level of the bottom of the suction chamber.

The vacuum cleaner structure and method of vacuum cleaning of the present invention are extremely simple and economical, while yet providing an effective and positive solution to the longstanding vexatious problem of vacuum cleaning adjacent upright wall surfaces.

BRIEF DESCRIPTION OF THE DRAWING

Other features and advantages of the invention will be apparent from the following description taken in connection with the accompanying drawing wherein:

FIG. 1 is a fragmentary isometric view of a front portion of a vacuum cleaner nozzle having means for picking up dirt from forwardly subjacent the suction chamber of the nozzle, embodying the invention;

FIG. 2 is a fragmentary exploded view thereof;

FIG. 3 is a fragmentary enlarged vertical section taken substantially along the line 3—3 of FIG. 1; and FIG. 4 is a view similar to that of FIG. 3, but illustrating the arrangement of the structure when juxtaposed to an upright wall surface.

DESCRIPTION OF THE PREFERRED EMBODIMENT

In the illustrative embodiment of the invention as disclosed in the drawing, a vacuum cleaner structure generally designated 10 is shown to include a nozzle 11 defining a front wall 12. The nozzle further defines a downwardly opening suction chamber 13 rearwardly of front wall 12 connected to a suitable conventional suction means 14 for applying suction to the chamber 13 for picking up dirt from subjacent the chamber.

As further illustrated in FIG. 3, a rotary brush 15 may be provided in chamber 13 for facilitating picking up dirt from subjacent flooring material, such as carpet 16.

As indicated briefly above, the present invention is concerned with the problem of picking up dirt from the subjacent floor adjacent an upright wall surface 17. More specifically, the invention comprehends the provision of one or more openings 18 comprising through openings in the front wall 12.

A closure member 19 is movably mounted to the front wall by means of pivot connectors 20 having an offset connecting portion 21 extending through suitable slits 22 in the front wall adjacent the opposite ends thereof.

The weight of closure member 19 gravity biases the closure member to the closed position across openings 18, as shown in FIG. 3. Additionally, suction pressure in chamber 13 acting through the openings 18 on the closure member 19 further urges it to the closed position.

Thus, the closure member effectively comprises means for closing the opening at all times when the front wall 12 is spaced from the upright surface a distance greater than a preselected distance. The structure includes means for moving the closure member from the opening against the suction force and gravity biasing thereof as an incident of juxtaposition of the front wall 12 to the surface 17, which, in the illustrated embodiment, comprises a pair of actuator buttons 23 slidably extending through openings 24 in front wall 12 above the slits 22. Each button includes an inner, enlarged head portion 25 limiting the forward movement of the button through the opening.

The length of the actuator button is preselected so as to cause the button to contact the wall surface 17 when the front wall 12 is juxtaposed thereto, as illustrated in FIG. 4. The engagement of the actuator button with the wall surface 17 causes the button to slide rearwardly through the opening 24 so as to urge the pivot connector 20 rearwardly, thereby moving the closure member 19 forwardly from the opening 18 against the gravity biasing and suction biasing forces so as to permit air flow from the area forwardly subjacent the front wall 12 and adjacent the upright wall surface 17. In the illustrated embodiment, openings 18 are disposed adjacent the level of the bottom of the suction chamber 13. As further illustrated in FIG. 4, the closure member defines a guide for directing air flow upwardly from forwardly subjacent the front wall through the openings 18 and facilitating pickup of dirt from the floor surface adjacent the wall surface 17 and permitting facilitated cleaning of the floor surface fully to the wall surface 17.

Referring to FIG. 3, when the nozzle front wall 12 is spaced from the upright wall surface a distance greater than the length of the actuator button 23, the button is urged outwardly until head 25 seats against the rear of the front wall 12 surrounding opening 24 by the gravity and suction biasing of the closure member 19 discussed above, thus effectively closing opening 18. However, when the nozzle front wall 12 is spaced from the upright wall surface 17 a difference less than the length of the actuator button 23 by nozzle movement toward the wall surface as shown in FIG. 4, the button is urged inwardly against pivot connector 20, forcing closure member 19 to pivot outward so that it no longer closes opening 18, permitting an air stream to enter the opening 18 and pass into suction chamber 13 carrying with it any dirt particles that may have been disposed between upright wall surface 17 and nozzle front wall 12. Thus, effectively, the actuator 23 defines a sensing means for determining the proximity of the upright wall surface and causing the uncovering of the openings 18 for facilitated pickup of dirt from forwardly subjacent the openings.

The nozzle may comprise a suitable vacuum cleaner nozzle, either of the upright or power brush attachment for a canister vacuum cleaner type. The invention comprehends providing a valve in the form of closure 19 which selectively opens and closes openings along the lower front edge of the nozzle under the automatic control of a sensing actuator projecting forwardly from the front wall of the nozzle. The actuator causes the desired removal of the closure member from the openings as an incident of the front wall being closely juxtaposed to the upright wall surface and, thus, provides an automatic means for arranging the vacuum cleaner for facilitated cleaning of the subjacent floor surface fully to the edge thereof at the upright wall surface.

The foregoing disclosure of specific embodiments is illustrative of the broad inventive concepts comprehended by the invention.

I claim:

1. In a vacuum cleaner having a nozzle defining a front wall, means defining a downwardly opening suction chamber rearwardly of the front wall, and means for applying suction to said chamber for picking up dirt from subjacent said chamber, the improvement comprising:

means for providing an opening to said chamber through said front wall;

closure means moveably mounted to said front wall to move forwardly thereof for selectively closing said opening; and means for sensing the proximity of said front wall to an upright wall surface and for causing said closure means to move forwardly of said front wall to discontinue closing said opening when said nozzle front wall is closely juxtaposed to said upright wall surface.

2. The vacuum cleaner structure of claim 1 wherein said opening is disposed adjacent the level of the bottom of said suction chamber.

3. The vacuum cleaner structure of claim 1 wherein said closure member is biased to the position thereof closing said opening.

4. The vacuum cleaner structure of claim 1 wherein said closure member is gravity-biased to the position thereof closing said opening.

5. The vacuum cleaner structure of claim 1 including means for directing air flow upwardly from forwardly subjacent said front wall through said opening.

6. The vacuum cleaner structure of claim 1 wherein said closure means further defines means for directing air flow upwardly from forwardly subjacent said front wall through said opening.

7. The vacuum cleaner structure of claim 1 wherein said closure means is pivotally mounted to said front wall.

8. The vacuum cleaner structure of claim 1 wherein said closure means is pivotally mounted to said front wall and said means for moving the closure means comprises means for moving one portion of the closure means rearwardly.

* * * * *